US011576832B1

(12) United States Patent
Kusens

(10) Patent No.: US 11,576,832 B1
(45) Date of Patent: Feb. 14, 2023

(54) VIRTUAL REALITY HEADREST CUSHION AND MOUNTING BRACKETS FOR MASSAGE TABLES AND CHAIRS

(71) Applicant: COLLATERAL OPPORTUNITIES, LLC, Wilmington, DE (US)

(72) Inventor: Michael Kusens, Southwest Ranches, FL (US)

(73) Assignee: COLLATERAL OPPORTUNITIES, LLC, Wilmington, DE (US)

( * ) Notice: Subject to any disclaimer, the term of this patent is extended or adjusted under 35 U.S.C. 154(b) by 51 days.

(21) Appl. No.: 16/784,969

(22) Filed: Feb. 7, 2020

Related U.S. Application Data

(62) Division of application No. 15/890,662, filed on Feb. 7, 2018, now Pat. No. 11,285,066.

(60) Provisional application No. 62/457,027, filed on Feb. 9, 2017.

(51) Int. Cl.

| | |
|---|---|
| ***A61G 13/12*** | (2006.01) |
| ***A61G 13/00*** | (2006.01) |
| ***A61G 15/12*** | (2006.01) |
| ***H04R 1/02*** | (2006.01) |
| ***A61G 15/00*** | (2006.01) |
| ***A47C 7/72*** | (2006.01) |
| ***A47C 21/00*** | (2006.01) |

(52) U.S. Cl.
CPC ..... *A61G 13/121* (2013.01); *A47C 7/727* (2018.08); *A61G 13/009* (2013.01); *A61G 15/007* (2013.01); *A61G 15/125* (2013.01); *H04R 1/028* (2013.01); *A47C 7/72* (2013.01); *A47C 21/003* (2013.01)

(58) Field of Classification Search
CPC ..... A47C 7/72; A47C 21/003; A61G 13/121; A61G 13/009
See application file for complete search history.

(56) References Cited

U.S. PATENT DOCUMENTS

| | | | | |
|---|---|---|---|---|
| 6,273,865 | B1 * | 8/2001 | Perez | A61G 15/007 601/46 |
| 7,694,370 | B1 * | 4/2010 | Lee | A61G 13/009 5/632 |
| 2005/0109346 | A1 * | 5/2005 | Cohen | A61G 13/12 128/845 |
| 2006/0290195 | A1 * | 12/2006 | Roleder | A47G 9/10 297/397 |
| 2014/0041122 | A1 * | 2/2014 | Haworth | A61G 7/072 5/632 |

* cited by examiner

*Primary Examiner* — David R Hare
*Assistant Examiner* — Adam C Ortiz
(74) *Attorney, Agent, or Firm* — Daniel S. Polley, P.A.

(57) ABSTRACT

A cushion member that is secured to a massage table or massage chair and contains a video or virtual reality headset within a substantially central opening or cutout of the cushion member to allow an individual to view video, virtual reality scenes, or other text, graphics or indicia while receiving a massage. A retaining shelf can also be secured to the cushion member to provide support for the video or virtual reality headset. Speakers can also be embedded in the cushion member or a headphone jack or port can be provided with the headset to also allow the individual to listen to any audio associated with the displayed material on the headset.

21 Claims, 14 Drawing Sheets

VIRTUAL REALITY HEADREST CUSHION AND MOUNTING BRACKETS FOR MASSAGE TABLES AND CHAIRS

This application is a divisional of U.S. application Ser. No. 15/890,662, filed Feb. 7, 2018, which claims the benefit of and priority to U.S. Provisional Patent Application Ser. No. 62/457,027, filed Feb. 9, 2017. Both applications are incorporated by reference in their entireties for all purposes.

FIELD OF THE DISCLOSURE

The disclosure is related to headrests for massage tables and chairs and more particularly, to the novel integration of a novel video or virtual reality headset into the headrest cushion of any massage table or chair.

BACKGROUND OF THE DISCLOSURE

Some of the primary reasons people get a massage are for stress relief, promotion of relaxation and anxiety relief. However, with traditional massage headrests, the view for the person is of the floor, wall and possibly the toes of the massage therapist. These views usually do not promote the stress relief and relaxation that a massage recipient seeks.

Novel non-limiting embodiments directed to addressing the above problems are described and shown below.

SUMMARY OF THE DISCLOSURE

An apparatus is provided for integrating a video or virtual reality headset into a massage cushion headrest for both chairs and tables. The disclosed embodiments can also incorporate audio to allow for massage recipients to experience a fully immersive massage.

The below disclosed novel cushion addresses the above noted problems by providing an integrated video or virtual reality headset into a massage headrest, thus allowing the massage recipient to be immersed in a world of relaxation or stress relief. The massage recipient can for example be immersed in a beach scene with a view of the sand and water while listening to the sounds of the waves crashing or be taken to a jungle paradise with waterfalls and foliage while listening to the sounds of the jungle.

The system can include a hand-held remote or microphone with voice recognition monitoring system that allows the user to make selection choices and/or control the video/audio. As non-limiting examples, the user can select the scene they want to be immersed in, control the volume or video brightness, browse the internet, watch live or prerecorded videos such as TV Shows, Movies or Sports.

Non-limiting definitions that will be used in describing certain embodiments include:

| | |
|---|---|
| Video or Virtual Reality (VR) Headset | A visual graphics screen and audible sound system worn over or in front of the head that immerses a user in a virtual world. It may use an integrated set of screens or the screen of an existing electronic device such as a smartphone or tablet to project the image and process all video and audio. Speakers, headphones or similar audio playback device may be incorporated into the headset. Port or wireless audio transmission capabilities can be made available for connecting headphones or other external speakers via a wire or over a wireless protocol such as, but not limited to, Bluetooth. |

-continued

| | |
|---|---|
| Headrest Cushion | A soft pillow-type device designed to support the face and head of a massage recipient. |
| Headrest Cushion Bracket | A rigid support structure that attaches to a massage table or chair and provides a base for the headrest cushion to attach to. |
| Massage Chair | An apparatus designed to allow a person to sit with their front side supported and receive a back massage. |
| Massage Table | An apparatus for a person to lay down on and receive a massage. The table can allow for a headrest cushion to be integrated into the table or can allow for a headrest cushion to be attached to the end of a table via the use of a headset cushion bracket. |
| Retaining Shelf | A platform that holds the video or virtual reality headset in place when installed in a headrest cushion, headrest cushion bracket or massage table. |

DETAILED DESCRIPTION

Figure 1:
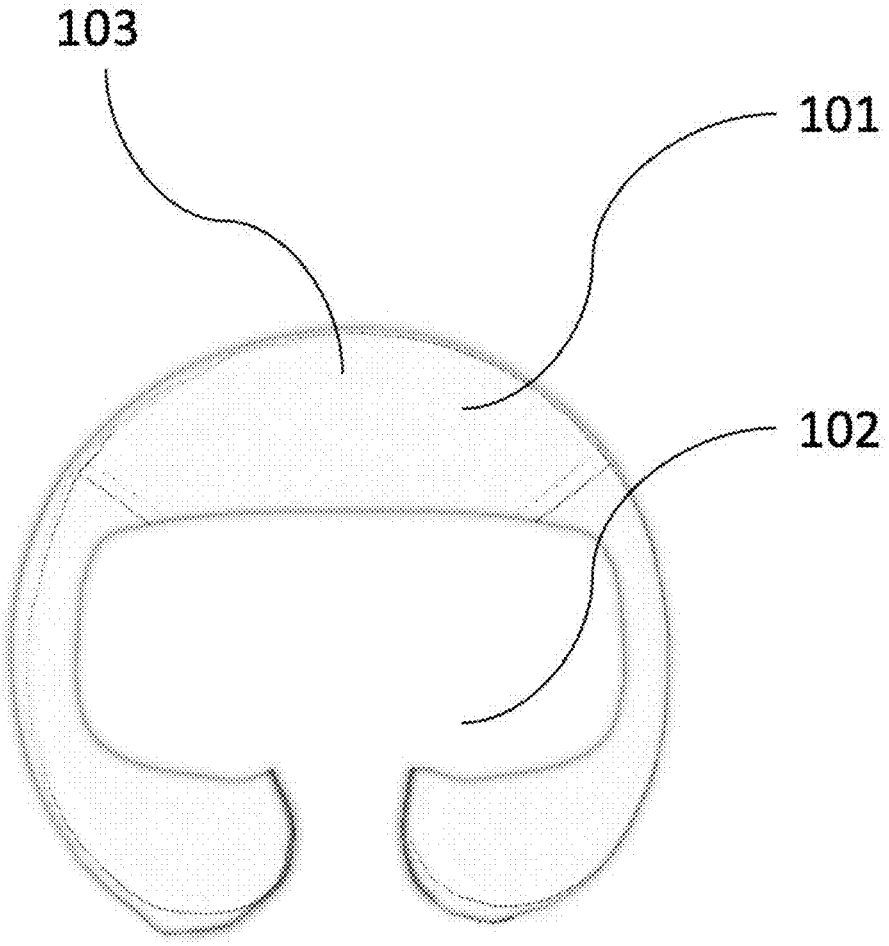
FIG. 1 illustrates a headrest cushion in accordance with one non-limiting embodiment of the present disclosure.

FIG. 1 illustrates a non-limiting embodiment for a headrest cushion that can be used with or as part of a novel video or virtual reality (collectively "VR") headset in accordance with the present disclosure. As seen, a headrest cushion 101 can be provided with a space cutout 102 to fit a video or virtual reality headset. The exact shape and size of the cutout 102 can depend on the specific make and model of video or virtual reality headset utilized with the headrest cushion and is not considered limited to any particular shape, shapes, size and/or sizes. The headrest cushion may optionally have a contoured section 103 with a raised or depressed area that can correspond to the contours of the VR headset and provides for a better fit or support. The exact shape and size of the raised or depressed contour can also vary and is also not considered limiting to any particular shape (d) and/or size(s).

Figure 2:
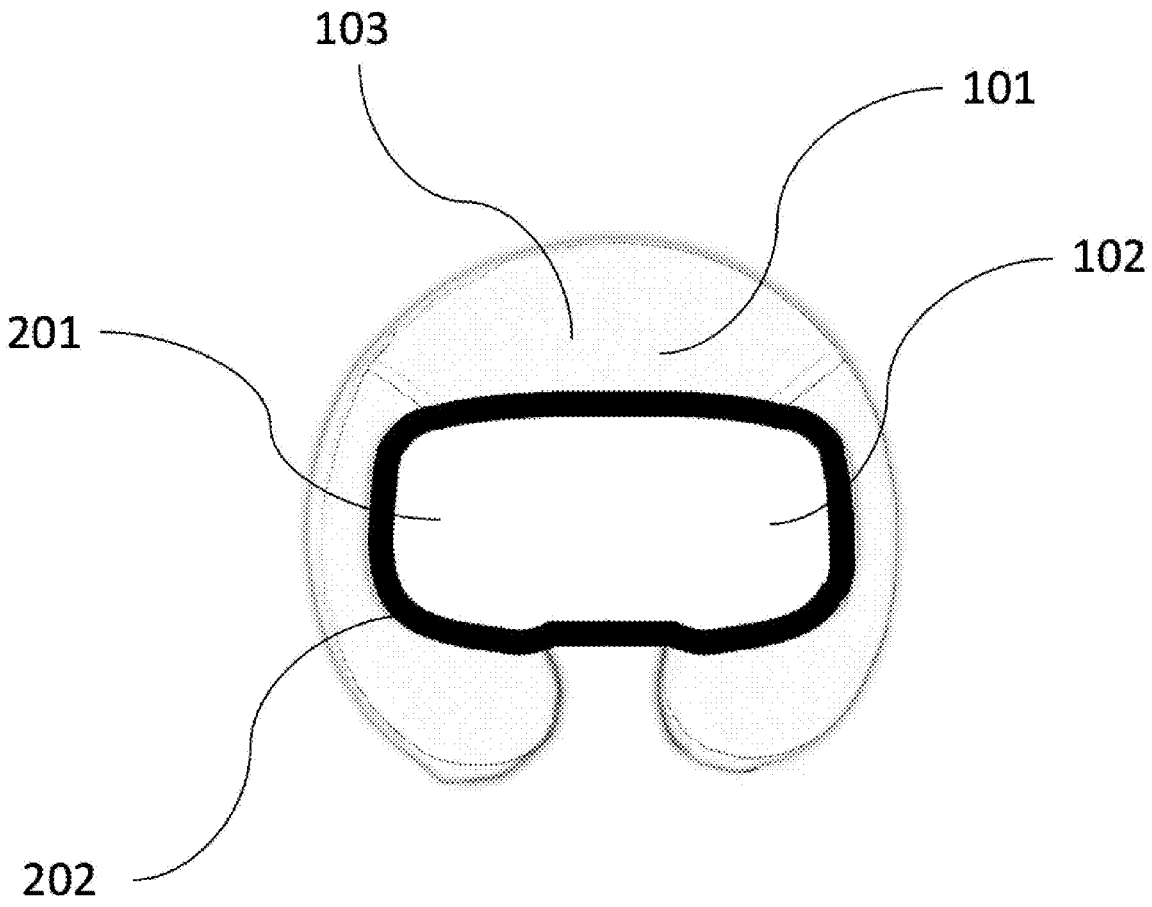
FIG. 2 illustrates the headrest cushion of FIG. 1 with a retaining shelf in accordance with one non-limiting embodiment of the present disclosure.

FIG. 2 shows a retaining shelf 201 secured or otherwise provided with headrest cushion 101. As shown in FIG. 2, headrest cushion 101 with video or virtual reality headrest cutout 102 and optional contoured section 103 can be provided with an incorporated retaining shelf 201 that can hold the video or virtual reality headset in place and can be preferably both secured to the headrest cushion and/or can be adjusted in height with the mounting brackets, straps, screws, webbing, fabric or other non-limiting methods 202. Additional, non-limiting examples include using hook and loop fasteners ("VELCRO") attached to the base and the top cushion, where the user detaches and reattaches the VELCRO to adjust the height. Another non-limiting example can include using a multi-level sliding bracket, such as or similar to those used for crutches to change the height. A further non-limiting example/method can include using a strap, such as or similar to those used for a backpack to adjust the length of the straps. Further non-limiting examples/methods can include a belt type strap with a buckle and holes in the belt, telescoping poles similar to a retractable car antenna, etc. These various non-limiting adjustment methods/examples are also considered applicable to all embodiments described below and incorporated by reference in the below discussions for all embodiments. Thus, though not limiting, it is preferred that the device have an adjustable height platform that can adjust to any size video or virtual reality headset. The exact or specific shape and size of the cutout 102 and/or retaining shelf 201 chosen can depend on the specific make and model of video or virtual reality headset utilized with the headrest cushion and is not considered limited to any particular shape, shapes, size and/or sizes.

Figure 3:
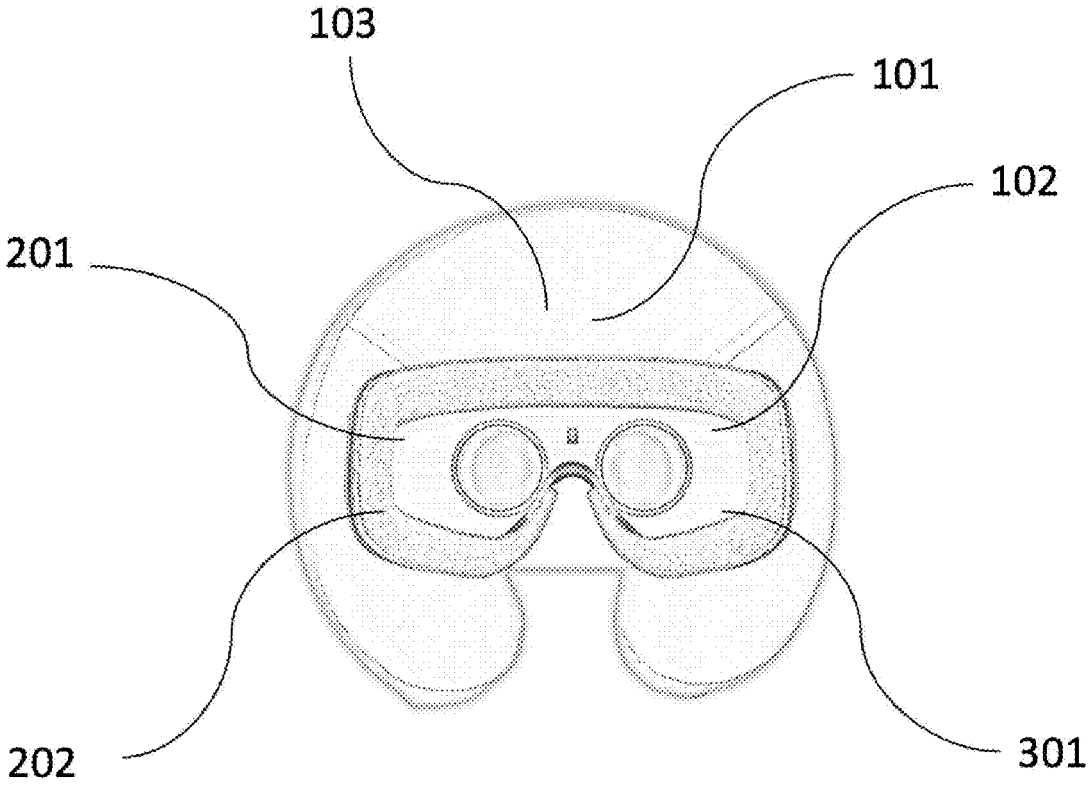
FIG. 3 illustrates the headrest cushion of FIG. 1 having a video or virtual reality headset installed in accordance with one non-limiting embodiment of the present disclosure.

FIG. 3 shows the headrest cushion 101 with a video or virtual reality headset 301 installed. As shown in FIG. 3, the headrest cushion 101 with cutout 102 and optional contoured section 103 has the retaining shelf 201 attached and can be secured by mounting brackets, straps, screws, webbing, fabric or other method 202. The video or virtual reality headset 301 is shown installed so that it preferable fits through the cutout 102, and rests on the retaining shelf 201.

Figure 4:
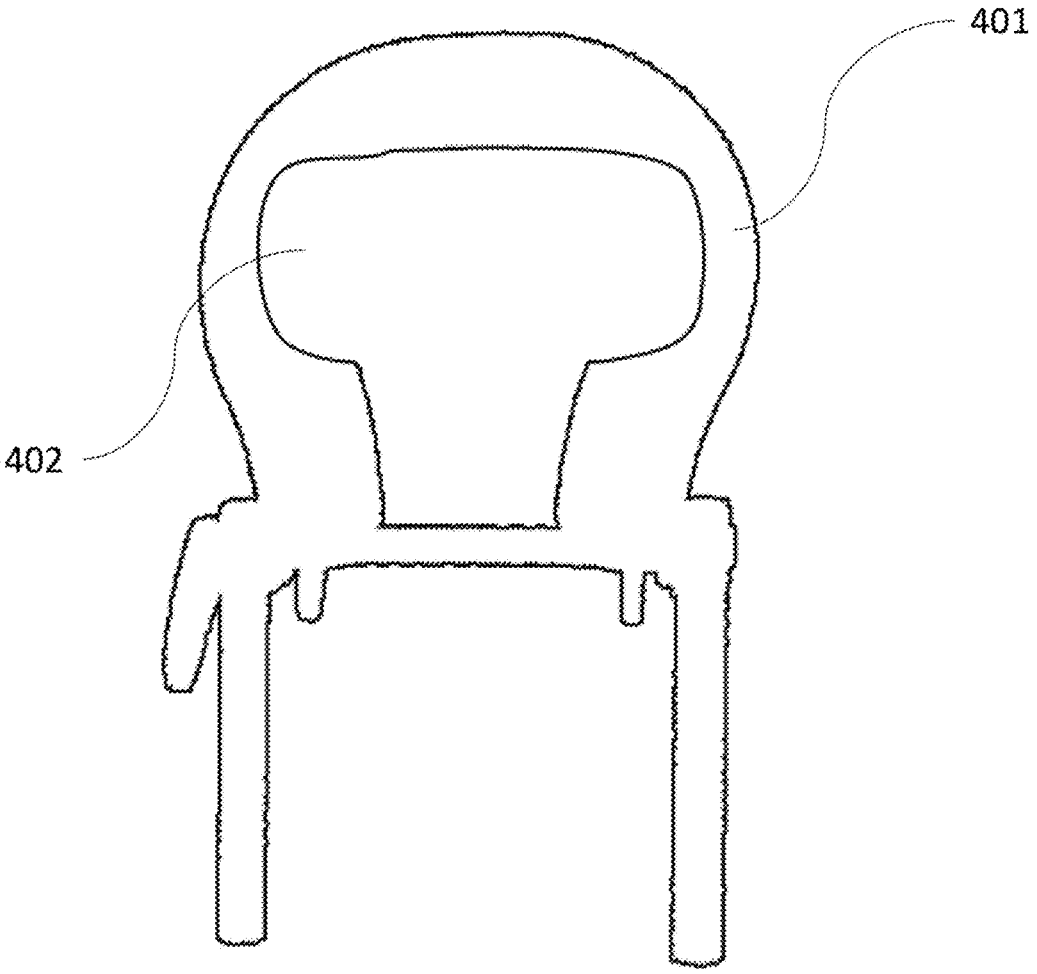
FIG. 4 illustrates a headrest cushion bracket in accordance with one non-limiting embodiment of the present disclosure.

FIG. 4 illustrates a non-limiting embodiment for a headrest cushion bracket 401 in accordance with the present disclosure. Headrest cushion bracket 401 can be shaped to provide a platform for the headrest cushion to reside on and can be preferably provided with a space cutout 402 to fit a video or virtual reality headset. The exact shape and size of cutout 402 can depend on the specific make and model of video or virtual reality headset utilized with the headrest cushion and is not considered limited to any particular shape, shapes, size or sizes. The exact shape and size of headrest cushion bracket 401 can also vary and can depend on the size of the headrest cushion or size desired to conform to different head sizes and is not considered limited to any particular shape, shapes, size or sizes. The downward or outward extending member(s) (i.e. posts, poles, etc.) preferably attach the headrest cushion bracket to the massage chair or table. In one non-limiting embodiment, these downward extending members/poles can slide into another pole or into brackets on the chair or table. The embodiment shown in FIG. 5, can be preferably designed to allow for a headrest cushion 101 with retaining shelf 201 and mounting brackets, straps, screws, webbing, fabric or other method 202 such as, but not limited to, those shown in or discussed with FIG. 2.

Figure 5:
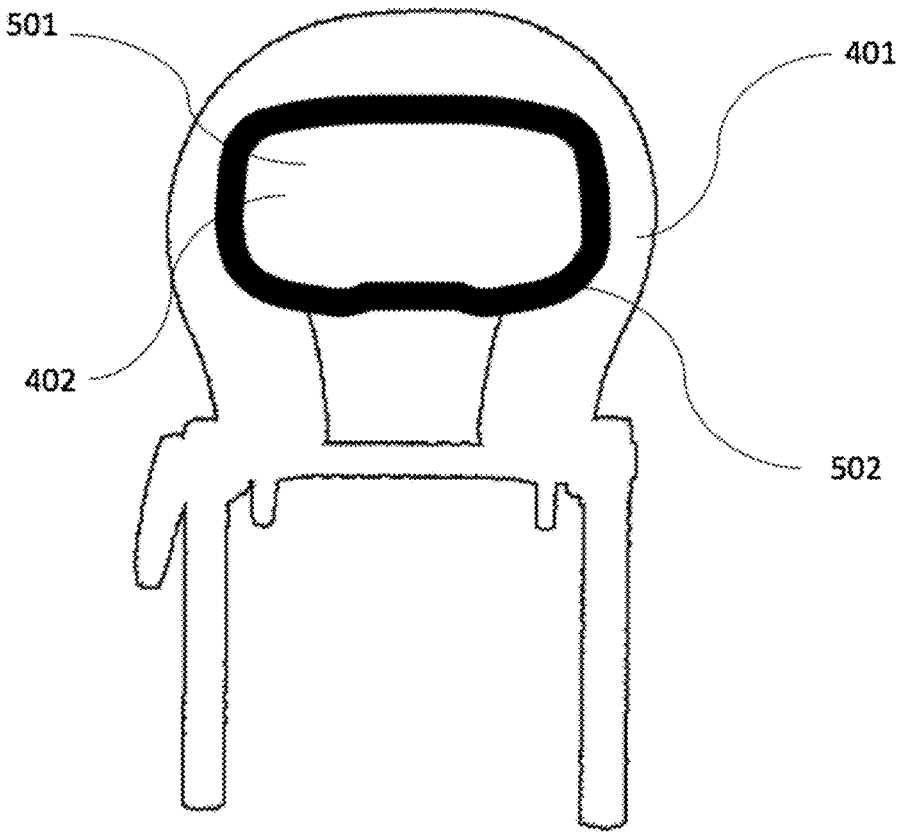
FIG. 5 illustrates the headrest cushion bracket of FIG. 4 with retaining shelf in accordance with one non-limiting embodiment of the present disclosure.

FIG. 5 illustrates the headrest cushion bracket embodiment of FIG. 4 with a retaining shelf secured thereto or provided therewith. Headrest cushion bracket 401 can be shaped to provide a platform for the headrest cushion to reside on and can be provided with a space cutout 402 to fit a video or virtual reality headset. A retaining shelf 501 that can be provided to preferably hold the video or virtual reality headset in place, can be secured to the headrest cushion and can be adjusted in height with mounting brackets, straps, screws, webbing, fabric or other conventional methods 502. The exact shape and size of the cutout 402 can depend on the specific make and model of video or virtual reality headset utilized with the headrest cushion and is not considered limited to any particular shape, shapes, size or sizes. The exact shape and size of the headrest cushion bracket 401 can also vary depend in on the size of the headrest cushion or size desired to conform to different head sizes and is not considered limited to any particular shape, shapes, size and/or sizes. The embodiment shown in FIG. 5 can allow for a headrest cushion 101 such as, but not limited to, those described and shown in FIG. 1 where the retaining shelf 402 can be integrated to the head rest cushion bracket 401.

Figure 6:
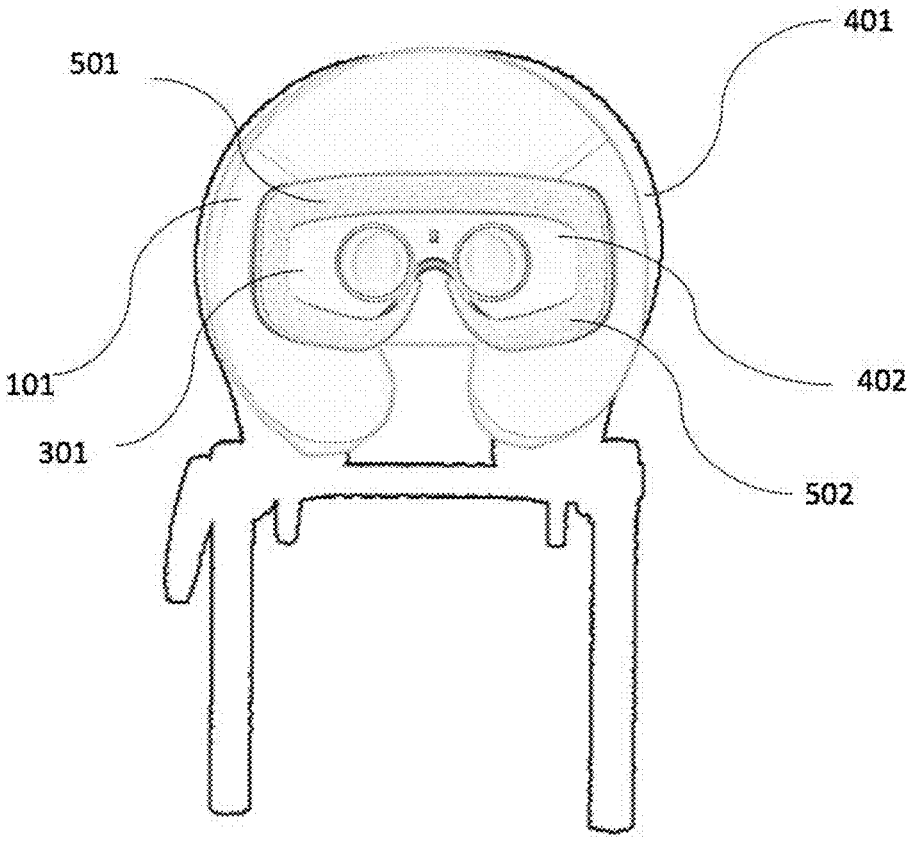
FIG. 6 illustrates the headrest cushion bracket of FIG. 4 with headrest cushion and video or virtual reality headset installed in accordance with one non-limiting embodiment of the present disclosure.

FIG. 6 illustrates the headrest cushion bracket of FIG. 4 with the video or virtual reality headset installed. As seen, headrest cushion bracket 401 can be shaped to provide a platform for the headrest cushion 101 to reside on and has a space cutout 402 to fit a video or virtual reality headset. Retaining shelf 501 can hold the video or virtual reality headset 301 in place and can be secured to the headrest cushion bracket 401 and can be adjusted in height with the mounting brackets, straps, screws, webbing, fabric or other conventional methods 502. The embodiment shown in FIG. 6 can be designed to allow for the video or virtual reality headset 301 to be supported by retaining shelf 501 installed with the mounting brackets, straps, screws, webbing, fabric or other conventional methods 502 on the headrest cushion bracket 401.

Figure 7:
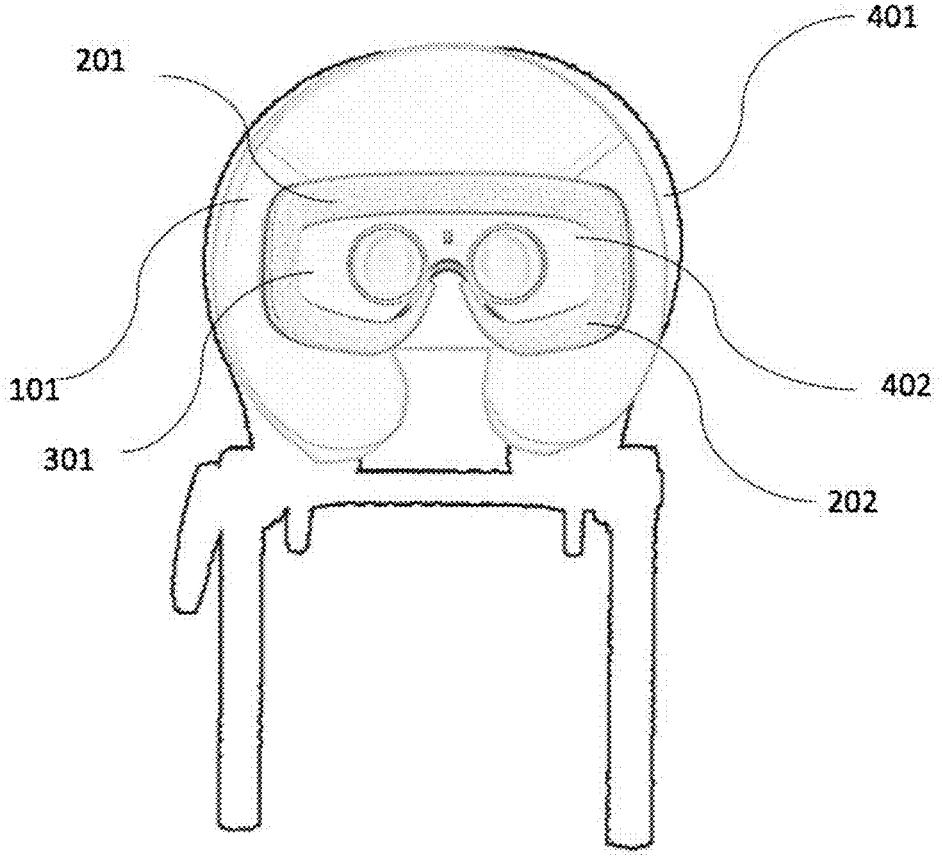
FIG. 7 illustrates another drawing of a headrest cushion bracket with headrest cushion and video or virtual reality headset installed in accordance with one non-limiting embodiment of the present disclosure.

FIG. 7 illustrates an additional embodiment for the headrest cushion bracket with the video or virtual reality headset installed. A primary difference between this embodiment and the embodiment shown in FIG. 6 can be where the retaining shelf is attached to. In the FIG. 6 embodiment, the retaining shelf can be attached to the cushion bracket while in the embodiment of FIG. 7 the retaining shelf can be attached to the headrest cushion itself. For the FIG. 7 embodiment, headrest cushion bracket 401 can be shaped to provide a platform for the headrest cushion 101 to reside on and can be provided with a space cutout 402 to fit a video or virtual reality headset. Retaining shelf 201 that holds the video or virtual reality headset 301 in place, can be secured to headrest cushion 101 and can be adjusted in height with the mounting brackets, straps, screws, webbing, fabric or other conventional methods 202. The FIG. 7 embodiment can be designed to allow for the video or virtual reality headset 301 to be supported by retaining shelf 201 installed with the mounting brackets, straps, screws, webbing, fabric or other conventional method 202 on the headrest cushion 101.

Figure 8:
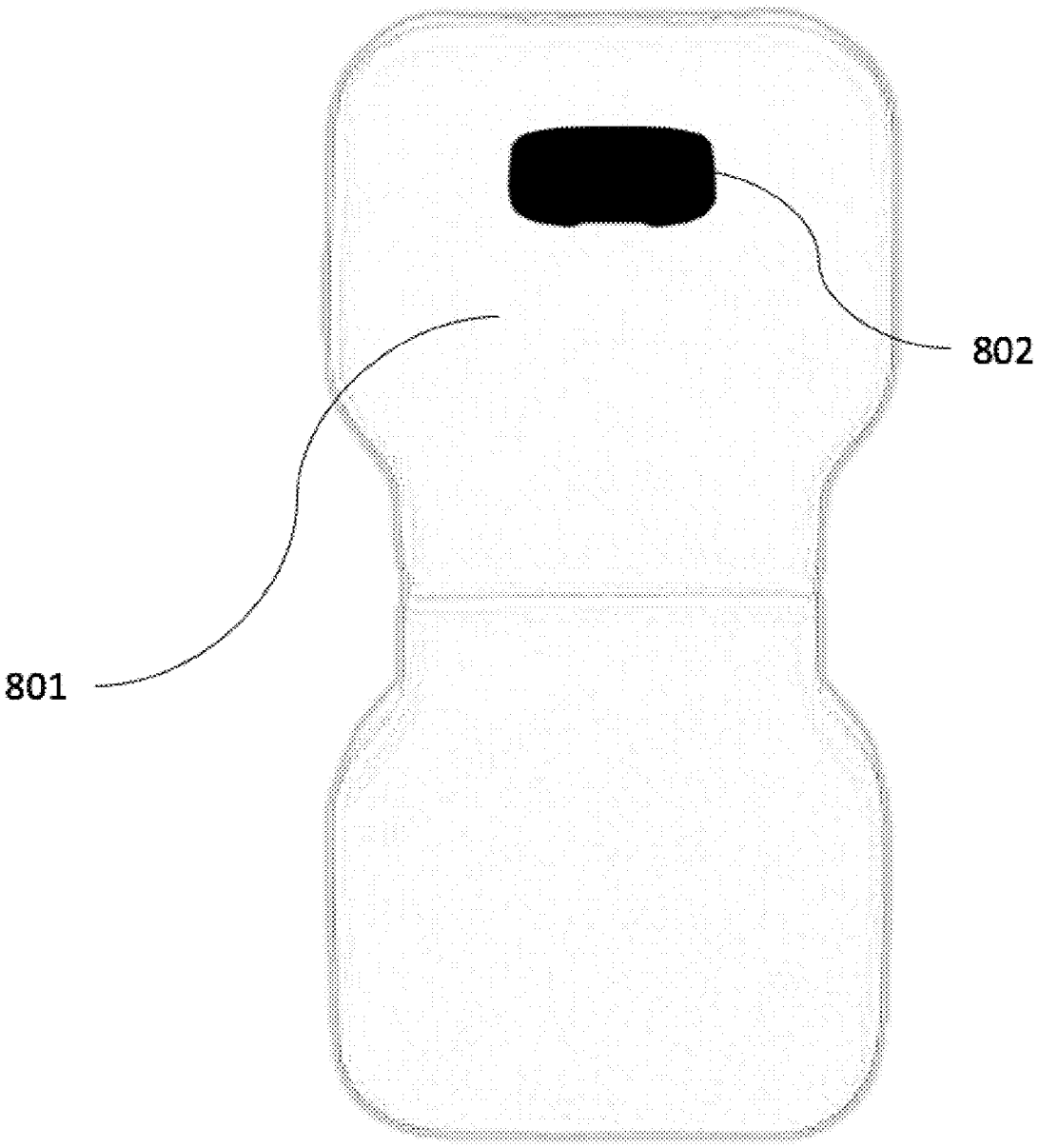
FIG. 8 illustrates a massage table with a cutout for a video or virtual reality headset in accordance with one non-limiting embodiment of the present disclosure invention.

FIG. 8 illustrates a first massage table with cutout embodiment, where the cutout is used for a video or virtual reality headset. As seen, massage table 801 can be provided with a cutout 802 to fit a video or virtual reality headset. The exact shape and size of the cutout 802 can depend on the specific make and model of video or virtual reality headset utilized with the headrest cushion and is not considered limited to any particular shape, shapes, size or sizes. The exact shape and size of the massage table 801 can also vary in size and shape and is not considered limited to any particular shape, shapes, size and/or sizes.

Figure 9:
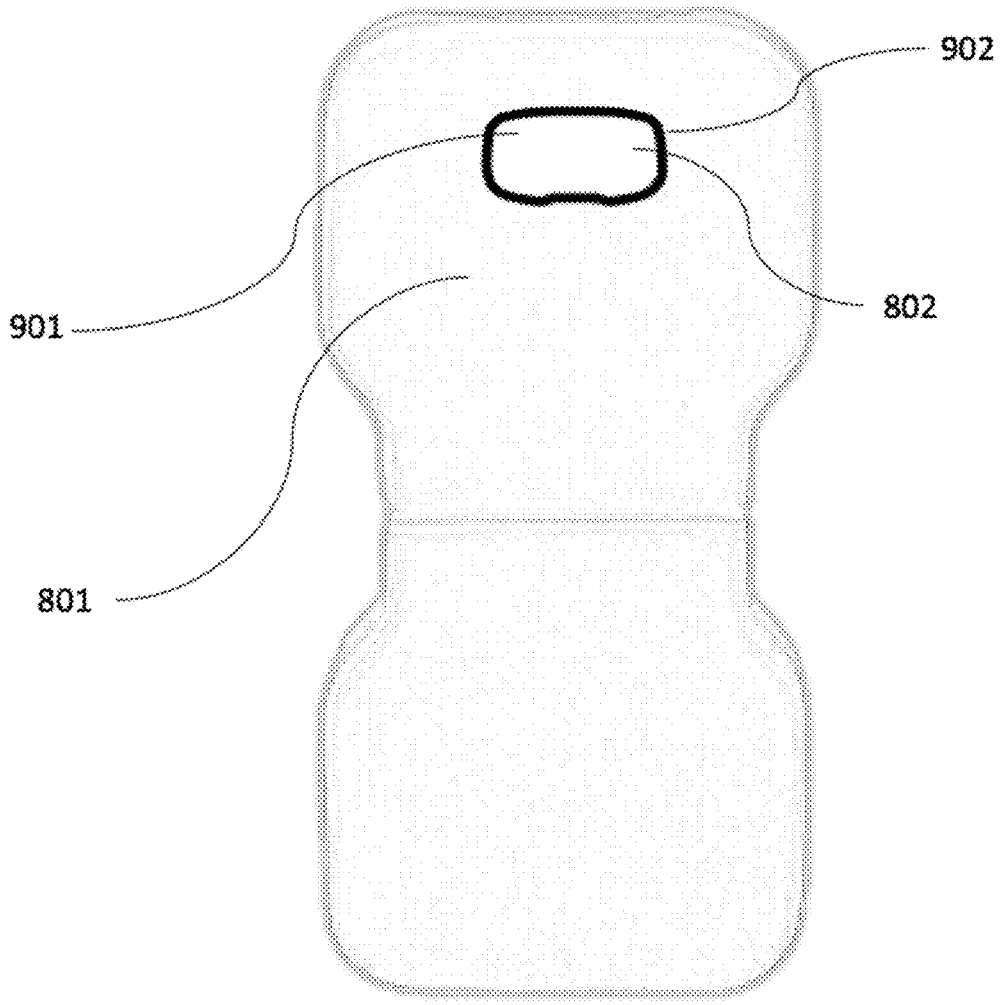
FIG. 9 is another drawing of a massage table with a cutout for a video or virtual reality headset in accordance with one non-limiting embodiment of the present disclosure.

FIG. 9 show the massage table 801 of FIG. 8 with a retaining shelf. As seen, massage table 801 has a cutout 802 to fit a video or virtual reality headset. The exact shape and size of the cutout 802 can depend on the specific make and model of video or virtual reality headset utilized with the headrest cushion and is not considered limited to any particular shape, shapes, size or sizes. The exact shape and size of the massage table 801 can also vary in size and shape and is not considered limited to any particular shape, shapes, size and/or sizes. Retaining shelf 901 can hold the video or virtual reality headset in place and can be secured to the headrest cushion and can be adjusted in height with the mounting brackets, straps, screws, webbing, fabric or other conventional method 902.

Figure 10:
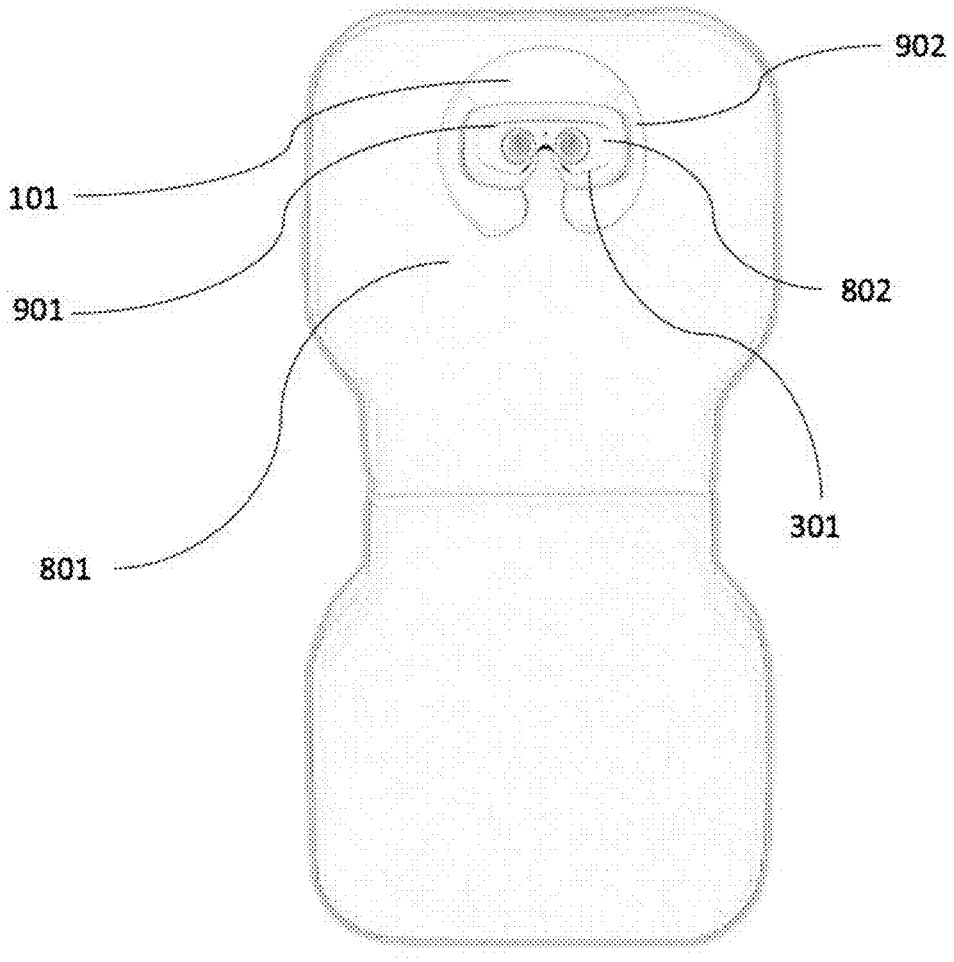
FIG. 10 illustrates a massage table with a headrest cushion and video or virtual reality headset installed in accordance with one non-limiting embodiment of the present disclosure.

FIG. 10 illustrates massage table of Figure with a video or virtual reality headset installed. As seen, massage table 801 has a cutout 802 to fit a video or virtual reality headset. The exact shape and size of the cutout 802 can depend on the specific make and model of video or virtual reality headset utilized with the headrest cushion and is not considered limited to any particular shape, shapes, size or sizes. The exact shape and size of the massage table 801 can also vary in size and shape and is not considered limited to any particular shape, shapes, size and/or sizes. Retaining shelf 901 that holds the video or virtual reality headset in place, can be secured to the massage table 801 and can be adjusted in height with the mounting brackets, straps, screws, webbing, fabric or other conventional methods 902. A headrest cushion 101 can be placed over cutout 802 and a video or virtual reality headset 301 is installed. The retaining shelf can be attached to the table itself. The cushion can go over the table and then headset can go into the cushion, while ultimately preferably being supported by the retaining shelf attached to the table.

Figure 11:
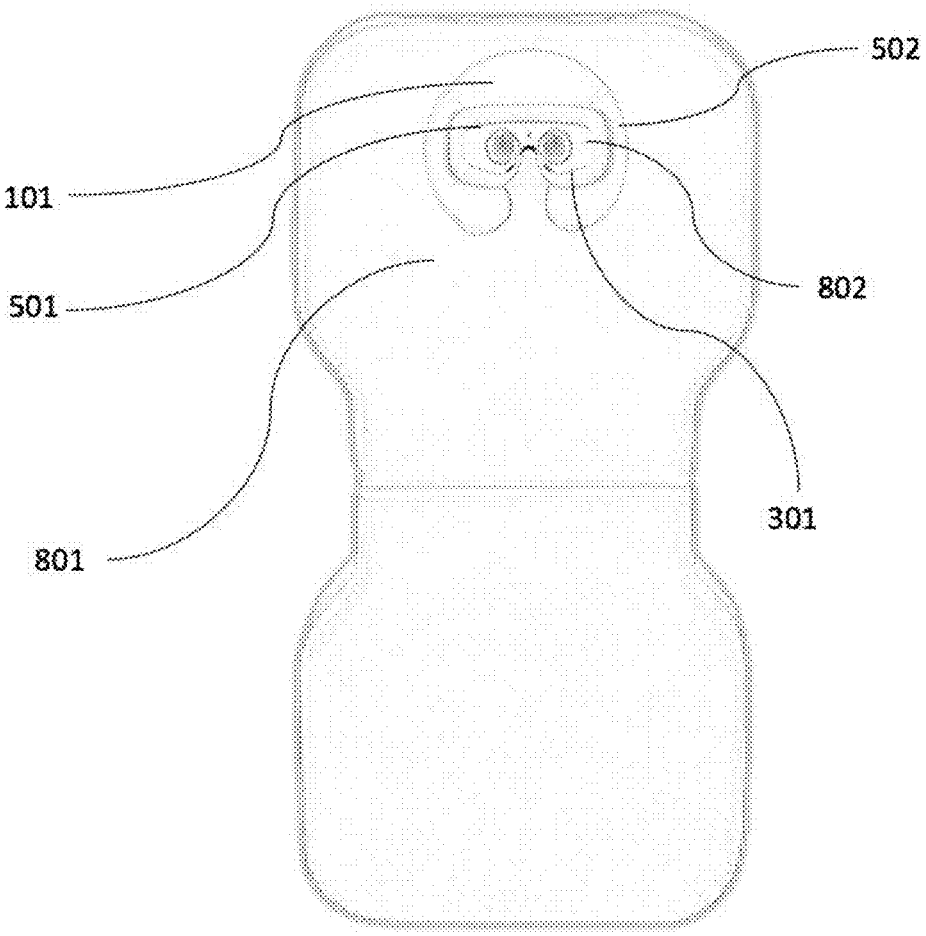
FIG. 11 is another drawing of a massage table with a headrest cushion and video or virtual reality headset installed in accordance with another non-limiting embodiment of the present disclosure.

In a slightly different embodiment to the embodiment in FIG. 10, FIG. 11 discussed below illustrates the retaining shelf preferably attached to the cushion and not the table. As seen, massage table 801 can be provided with a cutout 802 to fit a video or virtual reality headset. The exact shape and size of the cutout 802 can depend on the specific make and model of video or virtual reality headset utilized with the headrest cushion and is not considered limited to any particular shape, shapes, size or sizes. The exact shape and size of the massage table 801 can also vary in size and shape and is not considered limited to any particular shape, shapes, size and/or sizes. Retaining shelf 501 can hold the video or virtual reality headset in place and can be secured to the headrest cushion 101 and can be adjusted in height with the mounting brackets, straps, screws, webbing, fabric or other conventional methods 502. The headrest cushion 101 is placed over the cutout 802 and a video or virtual reality headset 301 can be installed. The primary difference between the embodiments of FIG. 10 and FIG. 11 is where the retaining shelf is attached. In FIG. 10, the retaining shelf can be preferably attached to the massage table itself. In FIG. 11, the retaining shelf can be preferably attached to the headrest cushion.

Figure 12:
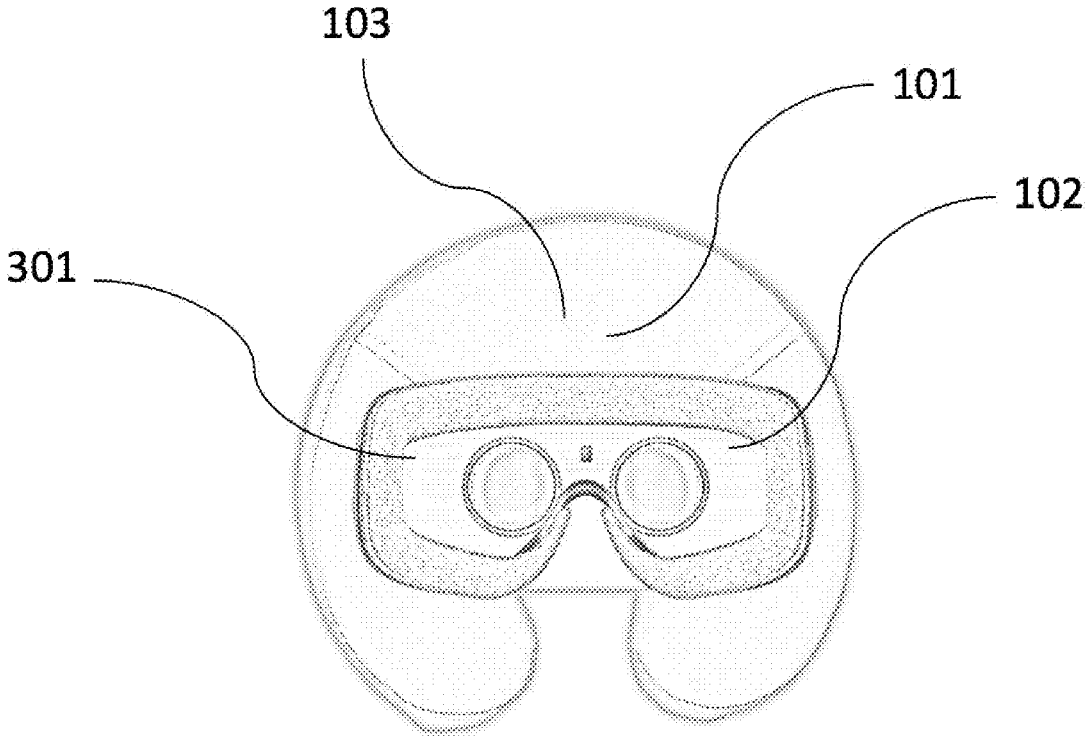
FIG. 12 illustrates a headrest cushion with video or virtual reality headset embedded in accordance with a further non-limiting embodiment of the present disclosure.

FIG. 12 shows the headrest cushion with a video or virtual reality headset embedded. As seen, headrest cushion 101 with video or virtual reality headset cutout 102 and optional contoured section 103 can have a video or virtual reality headset 301 incorporated in the cushion. The bottom side of the headrest cushion 101 and the video or virtual reality headset 301 can be flush with each other. The video or virtual reality headset 301 can be preferably held in place by either being adhered to the headrest cushion 101 around the perimeter of the headset cutout 102, or by the pressure of the headrest cushion 101 around the video or virtual reality headset 301. The exact shape and size of the cutout 102 and contour 103 can depend on the specific make and model of video or virtual reality headset 301 utilized with the headrest cushion 101 and is not considered limited to any particular shape, shapes, size and/or sizes.

Figure 13:
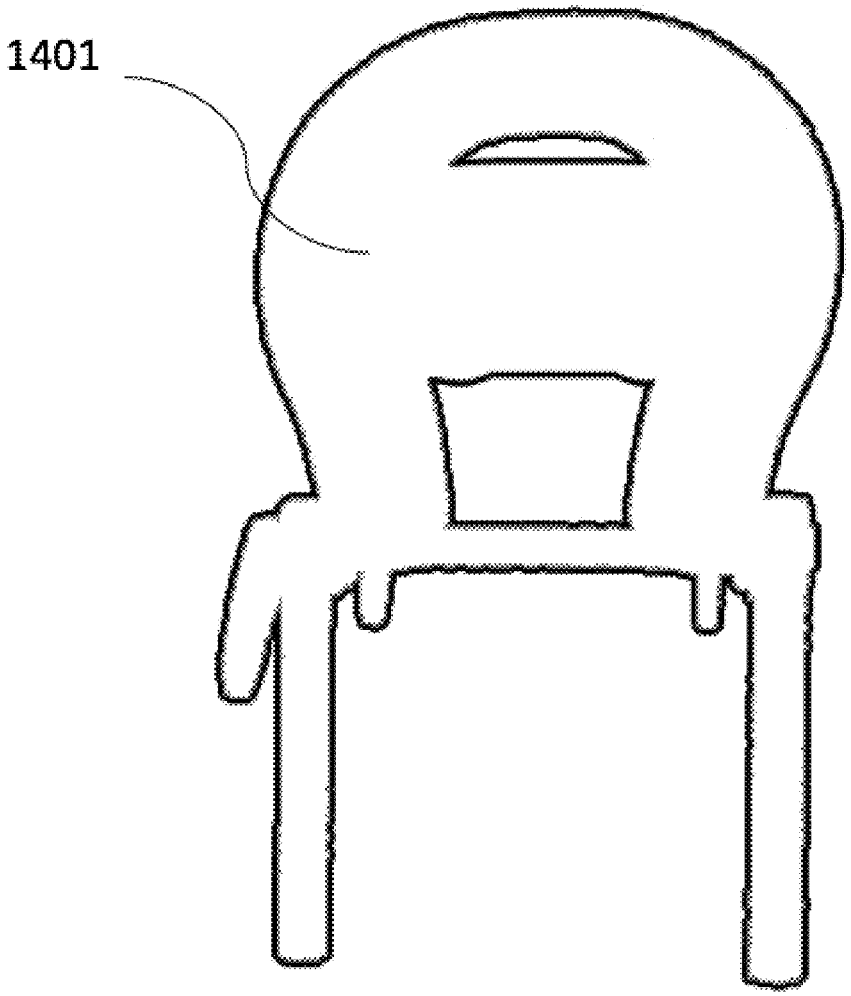
FIG. 13 illustrates a headrest cushion bracket illustrating in accordance with of one non-limiting embodiment of the present disclosure.

FIG. 13 shows a non-limiting embodiment for a headrest cushion bracket in accordance with the present disclosure. As seen, headrest cushion bracket 1401 can provide a base for the headrest cushion 101 and video or virtual reality headset 301 of FIG. 12 to be placed on. The headrest cushion bracket provides support for the headrest cushion 101 and video or virtual reality headset 301 when in use and allows attachment to a standard massage table or chair.

Figure 14:
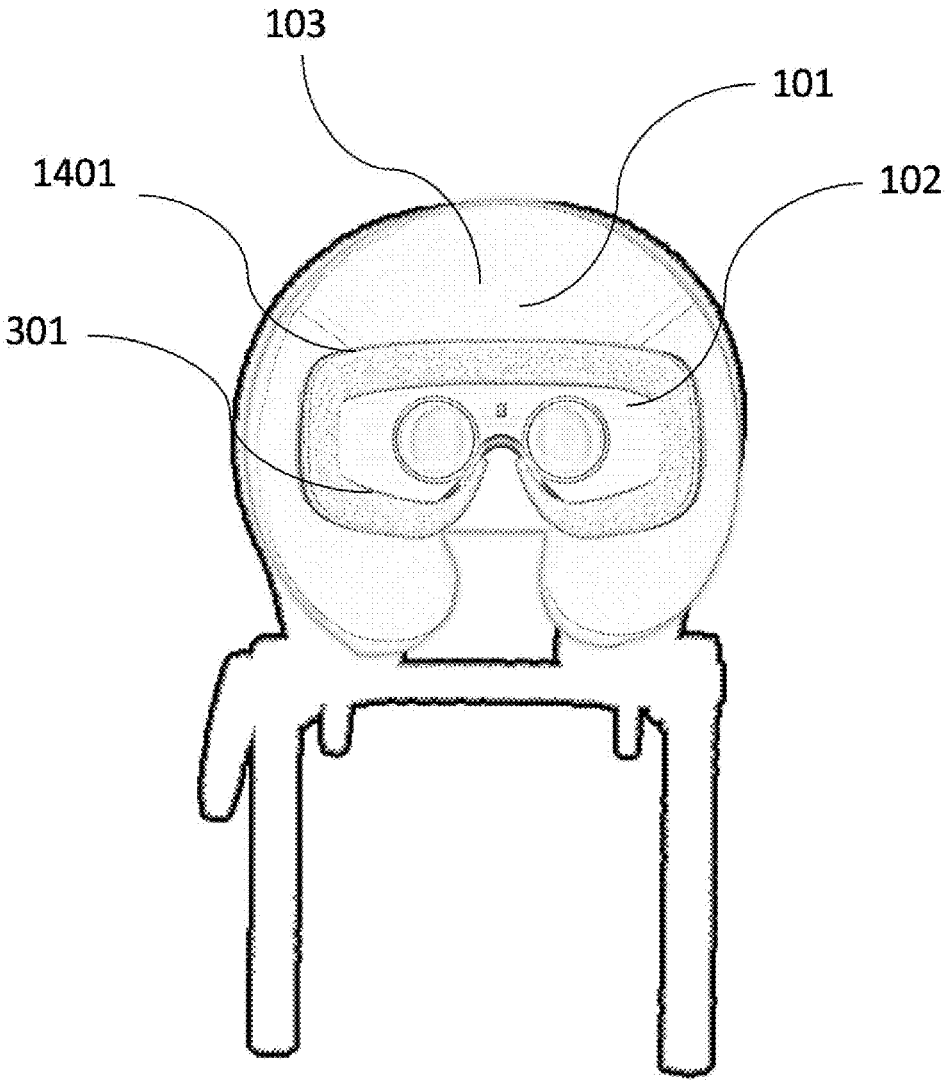
FIG. 14 illustrates a headrest cushion bracket with headrest cushion and video or virtual reality headset installed in accordance with of one non-limiting embodiment of the present disclosure.

FIG. 14 shows the headrest cushion bracket with the headrest cushion and video or virtual reality headset installed. As seen, headrest cushion bracket 1401 can be shaped to provide a platform for the headrest cushion 101 with cutout 102 and video or virtual reality headset 301 to reside on. Headrest cushion 101 can be adhered to the headrest cushion bracket 1401 using Velcro, adhesive, glues, tapes, or other type of bracket, and other types of securement methods and all are considered within the scope of the disclosure.

The embodiment shown and described for FIGS. 12-14 provides for a Video/Virtual Reality Headset attached to the cushion and resting on the cushion bracket. The headset cushion can have the Video/Virtual Reality headset flush with it, which can eliminate the retaining shelf. Here, the headrest cushion bracket itself can act as a retaining shelf or serve the same purpose as the retaining shelf described above, when the headrest cushion with the Video/Virtual Reality headset is put on top of the bracket.

The hole is normally where a person put their face into while having a massage. With the use of the disclosed embodiments, instead of staring into the ground (when lying on a massage table), the person receiving the massage can stare into the headset. The person's forehead can be positioned on the cushion, and the eye area having the goggles and the nose/mouth area in the middle are as normal. The cutout in the cushion allows the Video/Virtual Reality headset to be placed at a correct height such that it is preferably flush of or slightly below the existing cushion height.

The following non-limiting components can be preferably used for operation of the disclosed embodiments:

1. A massage headrest cushion;
2. A retaining shelf with adjustable mounting brackets (for certain embodiments);
3. A video or virtual reality headset The various components can be assembled as described in the figures.

Where speakers are provided with one or more of the above embodiments, they can be, without limitation, headphone style attached to the headset, speakers embedded in the cushion, a headphone jack to plug any headphone into, etc. The disclosure is not considered limited to any particular audio or sound producing device or method. In another embodiment, room speakers or other speakers can be used, such that the user can still communicate with a massage therapist. The form of speakers provided can be in wired or wireless communication with the virtual reality or video headset. Preferably, the headset in the opening can be similar to headsets normally worn on a person's face and can be provided with padding/cushioning of its own to conformt the user's face. Preferably, the headset can be flush with the massage cushion to provide a comfortable fit for the user.

Installing a video or virtual reality headset in a massage headrest cushion can provide significant enhancements to a traditional chair or table massage received by a typical individual of the general public, including, but not limited to, the following benefits:

1. Reduction in stress.
2. More enjoyable massages.
3. Reduction in ambient light and noises during a massage It should be understood that the exemplary embodiments described herein should be considered in a descriptive sense only and not for purposes of limitation. Descriptions of features or aspects within each embodiment should typically be considered as available for other similar features or aspects in other embodiments of the disclosure. While one or more embodiments have been described with reference to the figures, it will be understood by those of ordinary skill in the art that various changes in form and details may be made therein without departing from their spirit and scope.

In addition to video and/or virtual reality scenes, other indicia, such as, but not limited to text, graphics, etc. can also be displayed. Preferably, the headset can include a screen or a screen from a smartphone, etc. can be used. Other devices that can serve as a display can also be used and are considered within the scope of the disclosure. Furthermore, though the disclosed novel device is preferably used for displaying video, it is also within the scope of the disclosure that the device and method can also be used to just broadcast audio, such as, but not limited to, music, spoken word, etc. As one non-limiting example, the individual could listen to an audio book while receiving his or her massage.

All components of the described system and their locations, shapes, sizes, displays, securement techniques, adjustment mechanisms, dimensions, values, materials, etc. discussed above or shown in the drawings, if any, are merely by way of example and are not considered limiting and other component(s) and their locations, shapes, sizes, displays, securement techniques, adjustment mechanisms, dimensions, values, materials, etc. can be chosen and used and all are considered within the scope of the disclosure.

Unless feature(s), part(s), component(s), characteristic(s) or function(s) described in the specification or shown in the drawings for a claim element, claim step or claim term specifically appear in the claim with the claim element, claim step or claim term, then the inventor does not consider such feature(s), part(s), component(s), characteristic(s) or function(s) to be included for the claim element, claim step or claim term in the claim when and if the claim element, claim step or claim term is interpreted or construed. Similarly, with respect to any "means for" elements in the claims, the inventor considers such language to require only the minimal amount of features, components, steps, or parts from the specification to achieve the function of the "means for" language and not all of the features, components, steps or parts describe in the specification that are related or could be attributed to the function of the "means for" language.

The benefits, advantages, solutions to problems, and any element(s) that may cause any benefit, advantage, or solution to occur or become more pronounced are not to be construed or considered as a critical, required, or essential features or elements of any or all the claims.

While the novel virtual reality headrest cushion has been described and disclosed in certain terms and has disclosed certain embodiments or modifications, persons skilled in the art who have acquainted themselves with the invention, will appreciate that it is not necessarily limited by such terms, nor to the specific embodiments and modification disclosed herein. Thus, a wide variety of alternatives, suggested by the teachings herein, can be practiced without departing from the spirit of the disclosure, and rights to such alternatives are particularly reserved and considered within the scope of the disclosure.

The invention claimed is:

1. A method for displaying video, graphic, textual or virtual reality scenes to an individual while the individual receives a massage while lying face down on a massage table, the method comprising the steps of: a. securing a cushion member to a massage table, the cushion member having a substantially central located opening or cutout and the massage table having a horizontal or substantially horizontal lying surface such that the opening of the cushion member is also horizontally or substantially horizontally positioned for receipt of a portion of a face of the individual during use while the individual is lying on the massage table; b. securing a retaining shelf to the cushion member, the retaining shelf having an upper surface that is horizontally or substantially horizontally positioned; and c. positioning at least a portion of an electronic device on the horizontally or substantially horizontally positioned upper surface of the retaining shelf; the electronic device having a display screen or virtual reality headset within or underneath at least a portion of the opening or cutout such that when the individual lies face down on the massage table chair the individual can view video, graphics, text or other indicia being displayed from the electronic device having a display screen or virtual reality headset; wherein the cushion member includes a bracket member and step b. comprises the steps of securing the retaining shelf to the bracket member.

2. The method for displaying of claim 1 further comprising the steps of:

i. embedding at least one speaker within the cushion member, the at least one speaker being in communication with the electronic device having a display screen video or virtual reality headset; and ii. broadcasting any audio through the at least one speaker that is associated with the video, graphics, text or other indicia displayed by the electronic device having a display screen or virtual reality headset.

3. The method for displaying of claim 1 wherein the retaining shelf is secured around at least a portion of the opening or cutout.

4. The method for displaying of claim 1 wherein the cushion member includes a bracket member and step a. comprises the steps of securing the cushion member to a bracket member and securing the bracket member to the massage table.

5. The method for displaying of claim 1 wherein a portion of the cushion member which contacts a forehead area of the individual during use is contoured.

6. The method for displaying of claim 1 further comprising securing the cushion member to the electronic device having a display screen or virtual reality headset along an area of the electronic device or headset that comes into contact with a face portion of the individual.

7. The method for displaying of claim 1 further comprising the step of displaying video, virtual reality scenes, graphics, text or other indicia on the display screen of the electronic device or virtual reality headset while the individual lies on the massage table and is looking into the opening or cutout of the cushion member.

8. The method for displaying of claim 1 wherein the retaining shelf hangs down from the cushion member once secured in step b.

9. A method for displaying video, graphic, textual or virtual reality scenes to an individual while the individual receives a massage while lying face down on a massage table, the method comprising the steps of: a. securing a cushion member to a massage table, the cushion member having a substantially central located opening or cutout and the massage table having a horizontal or substantially horizontal lying surface such that the opening of the cushion member is also horizontally or substantially horizontally positioned for receipt of a portion of a face of the individual during use while the individual is lying on the massage table; b. securing a retaining shelf to the cushion member, the retaining shelf having an upper surface that is horizontally or substantially horizontally positioned; c. positioning at least a portion of an electronic device on the horizontally or substantially horizontally positioned upper surface of the retaining shelf; the electronic device having a display screen or virtual reality headset within or underneath at least a portion of the opening or cutout such that when an individual lies face down on the massage table chair the individual can view video, graphics, text or other indicia being displayed from the electronic device having a display screen or virtual reality headset; and d. displaying video, virtual reality scenes, graphics, text or other indicia on the display screen of the electronic device or virtual reality headset while the individual lies on the massage table and is looking into the opening or cutout of the cushion member; wherein the cushion member includes a bracket member and step b. comprises the steps of securing the retaining shelf to the bracket member.

10. The method for displaying of claim 9 further comprising the steps of:

i. embedding at least one speaker within the cushion member, the at least one speaker being in communication with the electronic device having a display screen video or virtual reality headset; and ii. broadcasting any audio through the at least one speaker that is associated with the video, graphics, text or other indicia displayed by the electronic device having a display screen or virtual reality headset.

11. The method for displaying of claim 9 wherein the retaining shelf is secured around at least a portion of the opening or cutout.

12. The method for displaying of claim 9 wherein the cushion member includes a bracket member and step a. comprises the steps of securing the cushion member to a bracket member and securing the bracket member to the massage table.

13. The method for displaying of claim 9 wherein a portion of the cushion member which contacts a forehead area of the individual during use is contoured.

14. The method for displaying of claim 9 further comprising the securing padding or cushioning to the electronic device having a display screen or virtual reality headset along an area of the electronic device or headset that comes into contact with a face portion of the individual.

15. The method for displaying of claim 9 wherein the retaining shelf hangs down from the cushion member once secured in step b.

16. A method for displaying video, graphic, textual or virtual reality scenes to an individual while the individual receives a massage while lying face down on a massage table, the method comprising the steps of: a. securing a cushion member to a massage table, the cushion member having a substantially central located opening or cutout and the massage table having a horizontal or substantially horizontal lying surface such that the opening of the cushion member is also horizontally or substantially horizontally positioned for receipt of a portion of a face of the individual during use while the individual is lying on the massage table; b. securing a retaining shelf to the cushion member, the retaining shelf having an upper surface that is horizontally or substantially horizontally positioned; c. positioning at least a portion of an electronic device on the horizontally or substantially horizontally positioned upper surface of the retaining shelf; the electronic device having a display screen or virtual reality headset within or underneath at least a portion of the opening or cutout such that when the individual lies face down on the massage table chair the individual can view video, graphics, text or other indicia being displayed from the electronic device having a display screen or virtual reality headset; d displaying video, virtual reality scenes, graphics, text or other indicia on the display screen of the electronic device or virtual reality headset while the individual lies on the massage table and is looking into the opening or cutout of the cushion member; e embedding at least one speaker within the cushion member, the at least one speaker being in communication with the electronic device having a display screen video or virtual reality headset; and e. broadcasting any audio through the at least one speaker that is associated with the video, graphics, text or other indicia displayed by the electronic device having a display screen or virtual reality headset; wherein the cushion member includes a bracket member and step b. comprises the steps of securing the retaining shelf to the bracket member.

17. The method for displaying of claim 16 wherein the retaining shelf is secured around at least a portion of the opening or cutout.

18. The method for displaying of claim 16 wherein the cushion member includes a bracket member and step a. comprises the steps of securing the cushion member to a bracket member and securing the bracket member to the massage table.

19. The method for displaying of claim 16 wherein a portion of the cushion member which contacts a forehead area of the individual during use is contoured.

20. The method for displaying of claim 16 further comprising the securing padding or cushioning to the electronic device having a display screen or virtual reality headset along an area of the electronic device or headset that comes into contact with a face portion of the individual.

21. The method for displaying of claim 16 wherein the retaining shelf hangs down from the cushion member once secured in step b.

* * * * *